US011106231B1

(12) United States Patent
Gomes et al.

(10) Patent No.: US 11,106,231 B1
(45) Date of Patent: Aug. 31, 2021

(54) CAPLESS VOLTAGE REGULATOR WITH ADAPTATIVE COMPENSATION

(71) Applicant: NXP USA, Inc., Austin, TX (US)

(72) Inventors: Vitor Moreira Gomes, Campinas (BR); Ricardo Pureza Coimbra, Campinas (BR); Andre Luis Vilas Boas, Amparo (BR)

(73) Assignee: NXP USA, Inc., Austin, TX (US)

( * ) Notice: Subject to any disclaimer, the term of this patent is extended or adjusted under 35 U.S.C. 154(b) by 0 days.

(21) Appl. No.: 17/038,134

(22) Filed: Sep. 30, 2020

(51) Int. Cl.
*G05F 1/10* (2006.01)
*G05F 1/575* (2006.01)

(52) U.S. Cl.
CPC ..... *G05F 1/575* (2013.01)

(58) Field of Classification Search
None
See application file for complete search history.

(56) References Cited

U.S. PATENT DOCUMENTS

| | | | | |
|---|---|---|---|---|
| 5,850,139 | A | 12/1998 | Edwards | |
| 8,816,658 | B1 | 8/2014 | De Vita et al. | |
| 8,841,892 | B2 * | 9/2014 | Nagda | G05F 1/10 323/269 |
| 9,261,892 | B2 * | 2/2016 | Wang | G05F 1/575 |
| 9,323,263 | B2 * | 4/2016 | Jain | G05F 1/565 |
| 9,389,620 | B2 * | 7/2016 | Banag | G05F 1/46 |
| 9,471,078 | B1 * | 10/2016 | Guan | G05F 1/56 |
| 9,966,941 | B2 * | 5/2018 | Dhamdhere | H03K 17/302 |
| 10,234,881 | B1 | 3/2019 | Goyal et al. | |
| 10,243,456 | B2 | 3/2019 | Pelicia et al. | |
| 10,444,778 | B2 * | 10/2019 | Vilas Boas | G05F 1/575 |
| 2002/0105382 | A1 | 8/2002 | Kadanka | |
| 2010/0156364 | A1 * | 6/2010 | Cho | G05F 1/573 323/280 |
| 2012/0153909 | A1 * | 6/2012 | Bucossi | H02M 3/1563 323/271 |
| 2018/0351450 | A1 * | 12/2018 | Pelicia | G05F 1/565 |

* cited by examiner

*Primary Examiner* — Thomas J. Hiltunen

(57) ABSTRACT

An integrated circuit (IC) is disclosed that includes a load circuit, and a voltage regulator circuit configured to provide a load voltage and a load current to the load circuit. The voltage regulator circuit can regulate the load voltage based on the load current.

12 Claims, 8 Drawing Sheets

CAPLESS VOLTAGE REGULATOR WITH ADAPTATIVE COMPENSATION

BACKGROUND

Capless voltage regulators (CVRs) supply power to subcircuits (e.g., high speed digital loads, memories, etc.) of integrated circuits (ICs). CVRs are low cost and do not occupy substantial IC substrate area since they do not require external capacitors, external pins, or large internal capacitors.

BRIEF DESCRIPTION OF THE DRAWINGS

The present technology may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
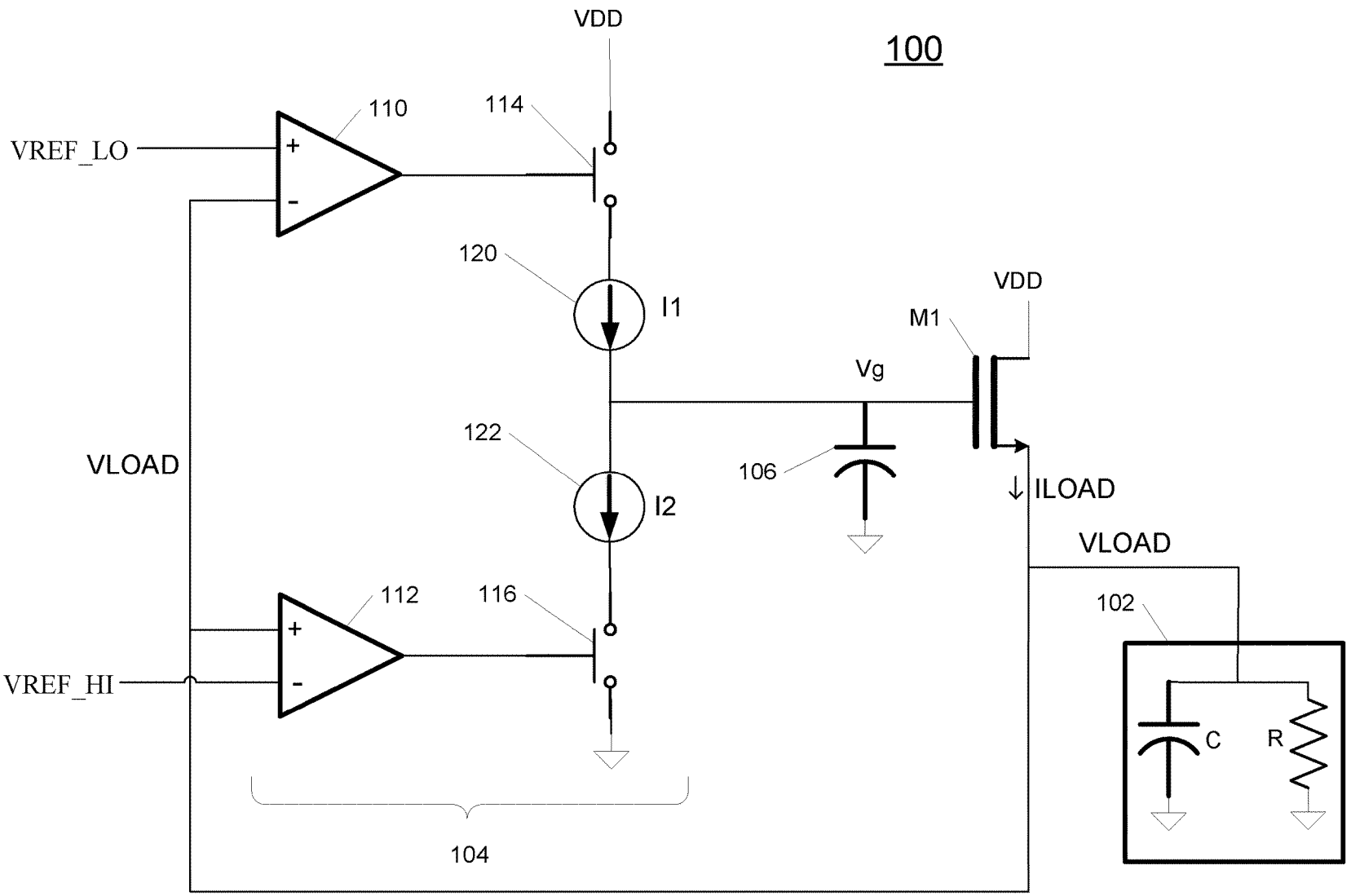
Fig. 1 (Prior Art)
FIG. 1 illustrates a prior art voltage regulator.

FIG. 1 illustrates an example CVR 100 that supplies load voltage VLOAD and load current ILOAD to a variable load circuit 102, which can be modelled as resistance R and capacitance C coupled in parallel. CVR 100 includes a switched biasing control circuit 104 that is connected to a pass device (e.g., N-channel metal oxide field effect transistor (MOSFET)) M1 and capacitor 106.

Biasing control circuit 104 controls the conductivity of pass device M1 via gate voltage Vg in response to a changing load that is sensed via the feedback of VLOAD. Switched biasing control circuit 104 includes two comparators 110 and 112 in a window comparison configuration. Comparator 110 receives a reference voltage VREF_LO and VLOAD as feedback, while comparator 112 receives a reference voltage and VREF_HI and VLOAD as feedback. When the load increases, suddenly more current is needed, and load current ILOAD is not supplied fast enough by CVR 100, so VLOAD drops below VREF_LO. When VLOAD is below reference voltage VREF_LO, switch 114 closes and current source 120 starts charging capacitance 106 with constant charging current IL which in turn increases Vg. VLOAD increases as Vg increases. Because charging current I1 is constant, Vg increases in a linear fashion. When load current ILOAD drops suddenly, the opposite reaction occurs and VLOAD rises above VREF_HI. When VLOAD is above VREF_HI, switch 116 closes and current source 122 starts discharging capacitance 106 with a constant discharge current I2, which in turn lowers Vg. VLOAD decreases as Vg decreases. Because discharge current I2 is constant, Vg decreases in a linear fashion.

CVRs respond to sudden load fluctuations. A CVR's response is measured by the time it takes for VLOAD to return to a stable voltage within the range defined by VREF_HI and VREF_LO after having fallen or risen. It takes time for biasing control 104 to respond to a change in the load and bring VLOAD back to a stable value. VLOAD can overshoot VREF_HI or undershoot VREF_LO during biasing control 104's response to a sudden change in the load, and this is particularly true as the range defined by VREF_HI and VREF_LO becomes tighter. The overshoot or undershoot can increase the response time for CVR 100.

A CVR with adaptive compensation is disclosed. The disclosed CVR employs a quasi-adaptive controller, which dynamically adjusts the slew rate of the pass device's gate voltage to follow the slew rate of the CVR output so that voltage overshoot and/or undershoot can be largely avoided. The quasi-adaptive controller enhances CVR accuracy and speed in responding to a change in the load, and promotes bonded-in bonded-out stability, i.e. the whole system is kept stable with little to no oscillatory response for all load range.

Figure 2:
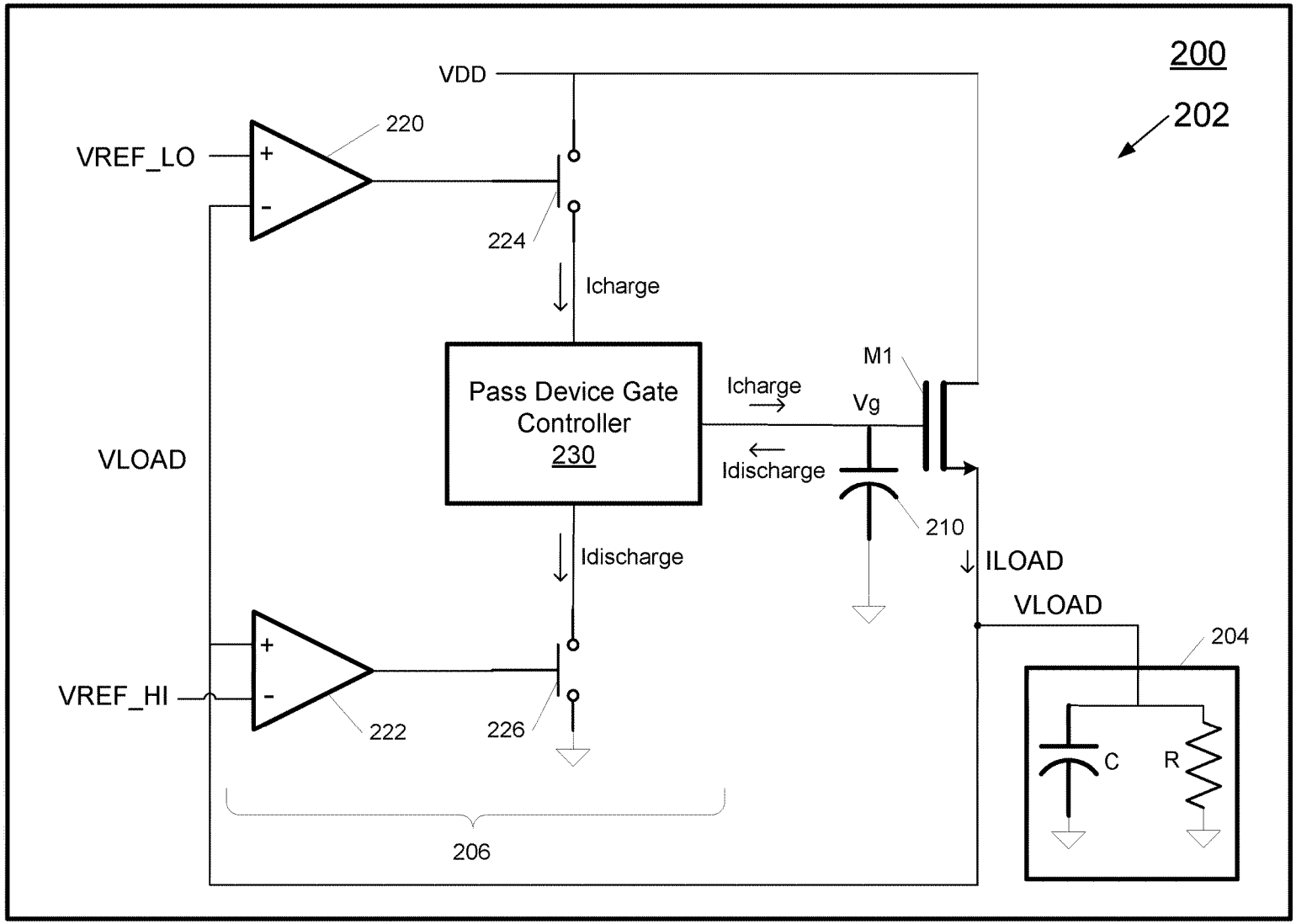
FIG. 2 illustrates a voltage regulator according to one embodiment of the present disclosure.

FIG. 2 illustrates an IC 200 (e.g., a microcontroller) that includes a CVR 202 according to one embodiment of the present disclosure. CVR 202 supplies output voltage VLOAD and output load current ILOAD to variable load circuit 204 (e.g., high speed digital load, memory, or other subcircuit of IC 200), which can be partially modelled as resistance R coupled in parallel with capacitance C.

CVR 202 includes a switched biasing control circuit 206 connected to pass device M1 and capacitor 210 as shown. Switched biasing control circuit 206 controls pass device M1 via gate voltage Vg, which in turn controls VLOAD. For purposes of explanation only, pass device M1 takes form in an N-channel MOSFET, and capacitor 210 includes, at the very least, the gate capacitance of M1. FIG. 2 shows the same supply voltage VDD coupled to switched biasing control circuit 206 and pass device M1. In an alternative embodiment distinct supply voltages are coupled to switched biasing control circuit 206 and pass device M1.

Switched biasing control circuit 206 includes two comparators 220 and 222 in a window comparison configuration. Comparator 220 receives reference voltage VREF_LO and VLOAD as feedback. Comparator 220 controls switch 224 (e.g., a MOSFET) based on a comparison of VREF_LO with VLOAD. Comparator 222 receives reference voltage VREF_HI and VLOAD as feedback. Comparator 222 controls switch 226 (e.g., a MOSFET) based on a comparison of VREF_HI with VLOAD. Lastly switched biasing control circuit 206 includes a pass device gate controller 230 coupled between switches 224 and 226. The pass device gate controller 230 dynamically adjusts the slew rate of gate voltage Vg to follow the slew rate of the CVR 202 output. In other words, pass device gate controller 230 can adjust the rate at which gate voltage Vg changes. In yet other words, pass device gate controller 230 can adjust gate voltage Vg in a non-linear fashion.

Reference voltages VREF_HI and VREF_LO set a range for VLOAD. Reference voltage VREF_LO (e.g., 500 mV) is lower than reference voltage VREF_HI (e.g., 600 mV). When output voltage VLOAD falls below reference voltage VREF_LO due to, for example, a change in the load, switch 224 closes, and pass device gate controller 230 starts charging capacitor 210 with charging current Icharge, which in turn increases Vg. VLOAD increases with Vg. As VLOAD increases, ILOAD decreases. The rate at which pass device gate controller 230 charges capacitor 210 depends on ILOAD. Thus Icharge can vary in magnitude, or in other words Icharge may be non-linear. VLOAD should increase as Vg increases until VLOAD exceeds VREF_LO, at which point switch 224 is opened by comparator 220. Since Icharge may be non-linear, Vg and VLOAD may increase in a non-linear fashion. For example, Vg and VLOAD can increase at slowing rates, which can prevent an overshoot of VREF_HI. When VLOAD is less than VREF_HI and greater than VREF_LO, both switches 224 and 226 should open, and Vg (and thus VLOAD) should hold steady assuming load 204 remains constant.

When VLOAD rises above the VREF_HI value, switch 226 closes, and pass device gate controller 230 starts discharging capacitor 210 with discharge current Idischarge, which in turn decreases Vg. VLOAD decreases as Vg decreases. Idischarge may be constant, and as a result Vg decreases linearly or at a constant rate. VLOAD should decrease as Vg decreases until VREF_HI exceeds VLOAD, at which point switch 226 is opened by comparator 222. Alternatively, Idischarge can vary in magnitude, or in other words Idischarge may be non-linear. In this alternative embodiment, Idischarge may depend on ILOAD, and as a result the rate at which pass device gate controller 230 discharges capacitor 210 may depend on the magnitude of ILOAD. VLOAD should decrease as Vg decreases until VREF_HI exceeds VLOAD, at which point switch 226 is opened by comparator 222.

As noted, when VLOAD falls below VREF_LO, pass device gate controller 230 increases Vg by charging capacitor 210, which in turn increases VLOAD, and when VLOAD rises above VREF_HI, pass device gate controller 230 decreases Vg by discharging capacitor 210, which in turn decreases VLOAD. Pass device gate controller 230 is configured to change Vg at a rate that is slower than the rate at which VLOAD changes, at least towards the end of the capacitor charging cycle, in order to prevent VLOAD from overshooting VREF_HI. Switched biasing control circuit 206 in general and device gate controller 230 in particular promotes bonded-in bonded-out stability, i.e. the whole system is more stable with less oscillatory response caused by VREF_HI overshoot and/or VREF_LO undershoot for an anticipated load range.

Figure 3:
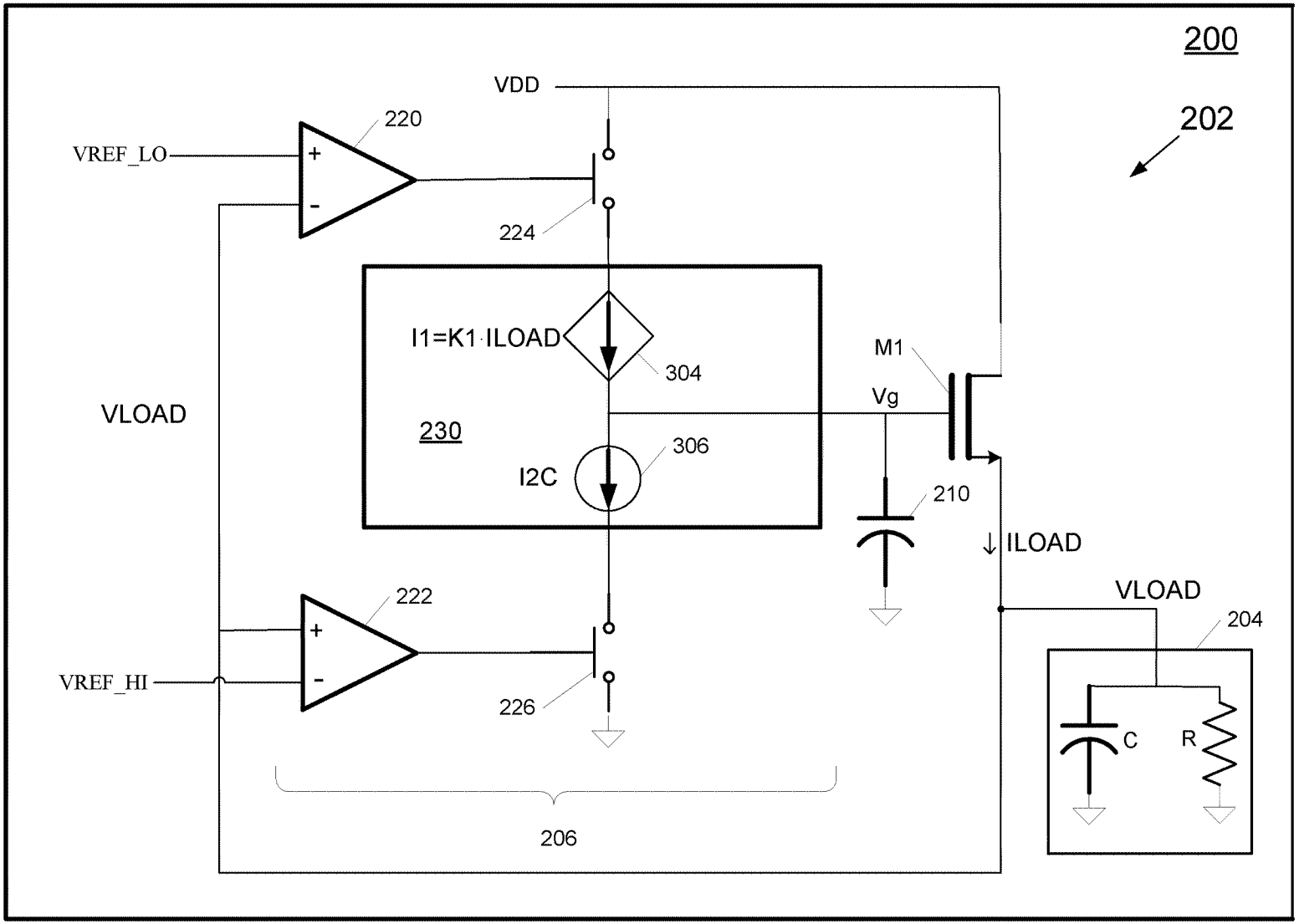
FIG. 3 illustrates an embodiment of the pass device gate controller employed in the voltage regulator of FIG. 2.

FIG. 3 illustrates one embodiment of the pass device gate controller (hereinafter gate controller) 230. In this embodiment, gate controller 230 includes a variable current source 304 and a constant current source 306 arranged as shown between switches 224 and 226. Current sources 304 and 306 are configured to charge and discharge capacitor 210, respectively. Variable current source 304 can charge capacitor 210 with variable current I1 when switch 224 is closed by comparator 220 (i.e., when VREF_LO is greater than VLOAD). Current I1 depends upon load current ILOAD. More particularly, I1=K1·ILOAD, where K1 is a predetermined value. Gate voltage Vg, and thus VLOAD, increases as capacitor 210 is charged by IL The rate at which Vg increases depends upon the magnitude of ILOAD. K1 can be selected so that Vg increases at a rate that is slower than the rate at which VLOAD increases to avoid overshooting VREF_HI and activating switch 226. Constant current source 306 can discharge capacitor 210 with constant current I2C when comparator 222 closes switch 226. Gate voltage Vg, and thus VLOAD, decreases as capacitor 210 is discharged by current source 306.

Figure 4:
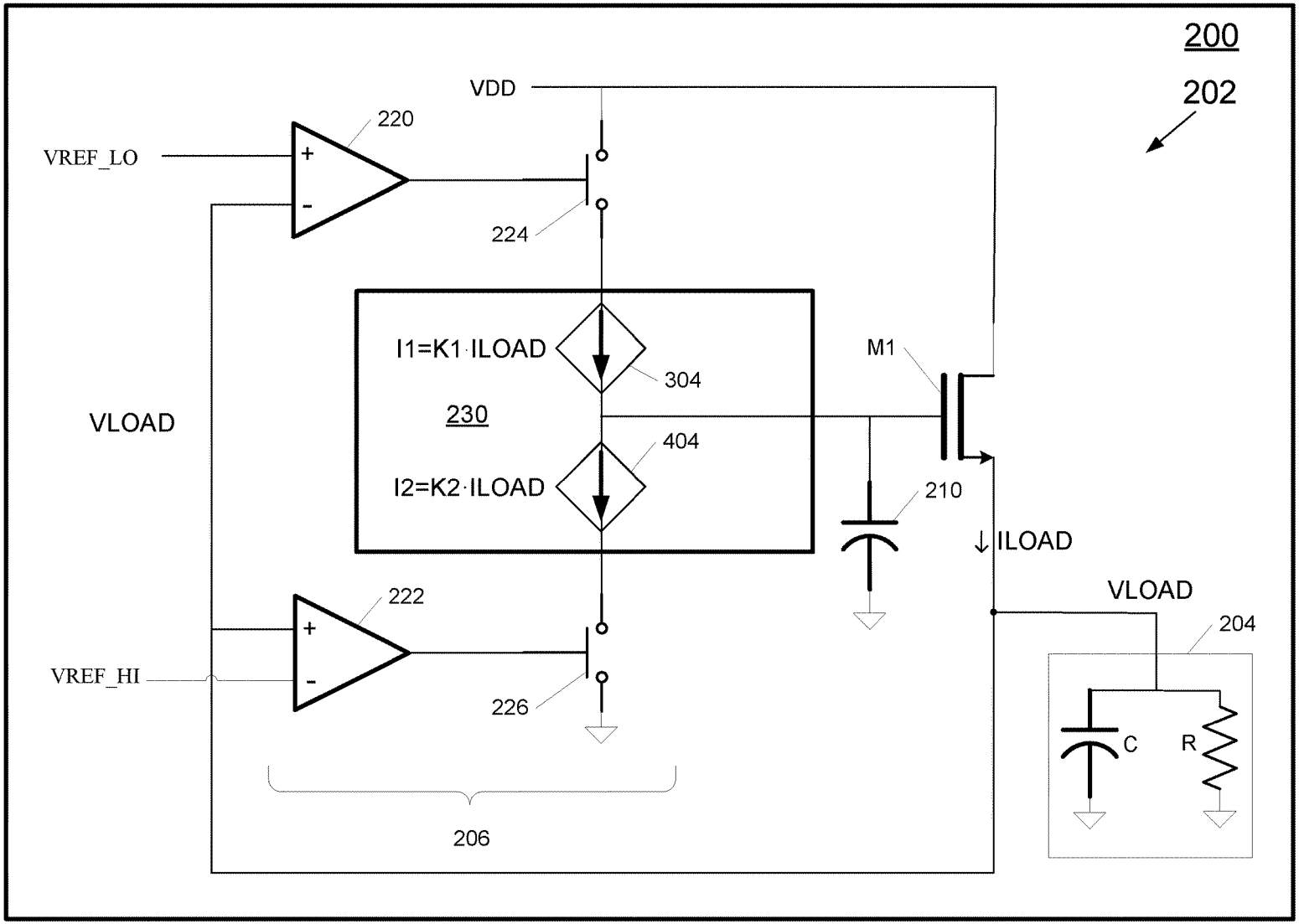
FIG. 4 illustrates an embodiment of the pass device gate controller employed in the voltage regulator of FIG. 2.

FIG. 4 illustrates an alternative embodiment of gate controller 230 shown in FIG. 2. Gate controller 230 in this embodiment is essentially the same as the gate controller 230 shown within FIG. 3, but with constant current source 306 replaced by variable current source 404. When switch 226 is closed by comparator 222 (i.e., when VLOAD is greater than VREF_HI), variable current source 404 can discharge charge capacitor 210 with variable current I2 that depends upon ILOAD. In the illustrated embodiment, I2=K2·ILOAD, where K2 is a predetermined value. K1 and K2 may be different from each other. For example, K2 can be less than K1. Or K1 and K2 may be equal. Gate voltage Vg, and thus VLOAD, decreases as capacitor 210 is discharged by variable current I2. K2 can be selected so that Vg decreases at a rate that is slower than the rate at which VLOAD decreases to avoid undershooting VRER_LO and activating switch 224.

Figure 5:
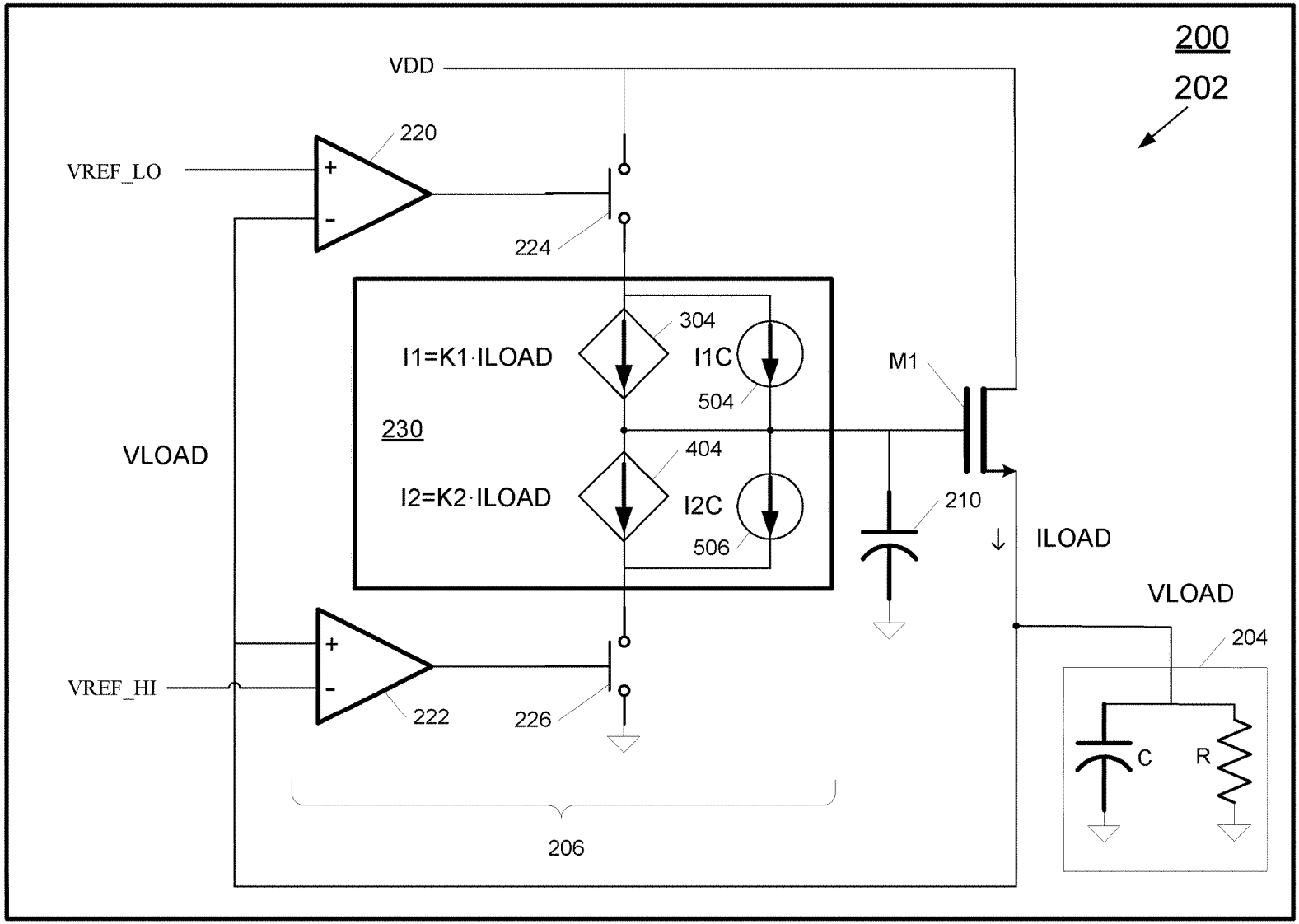
FIG. 5 illustrates an embodiment of the pass device gate controller employed in the voltage regulator of FIG. 2.

FIG. 5 illustrates yet another embodiment of gate controller 230 shown in FIG. 2. Gate controller 230 in this configuration is essentially the same as gate controller 230 shown in FIG. 4, but with added constant current sources 504 and 506. Constant current source 504 is connected in parallel with variable current source 304, while constant current source 506 is connected in parallel with variable current source 404. When switch 224 is closed, variable current source 304 and constant current source 504 charge capacitor 210 with variable current I1 and constant current I1C. Constant current source 504 insures capacitor 210 is charged when load current ILOAD approaches 0 A. Gate voltage Vg, and thus VLOAD, increases as capacitor 210 is charged by I1 and I1C. Vg should increase at a rate that is slower than the rate at which VLOAD increases. When switch 226 is closed, variable current source 404 and constant current source 506 discharge capacitor 210 with variable current I2 and constant current I2C. Gate voltage Vg, and thus VLOAD, decreases as capacitor 210 is discharged by I2 and I2C. Constant current source 506 insures capacitor 210 is discharged when load current ILOAD approaches 0 A. Vg may decrease at a rate that is slower than the rate at which VLOAD decreases. Current sources 504 and 506 guarantee a minimum amount of current for charging and discharging capacitor 210.

Figure 6:
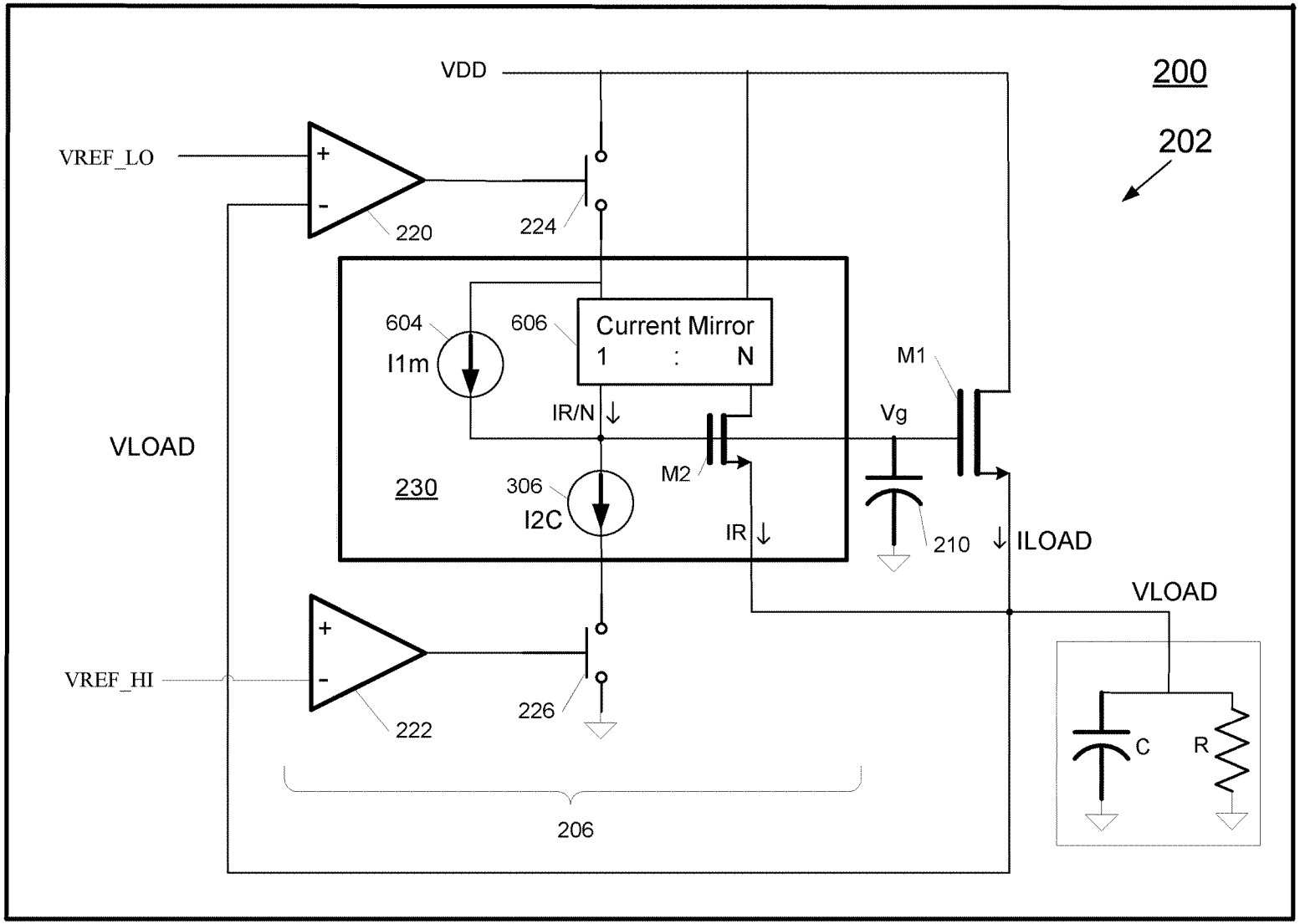
FIG. 6 illustrates an embodiment of the pass device gate controller employed in the voltage regulator of FIG. 2.

FIG. 6 illustrates still another embodiment of the gate controller 230 shown in FIG. 2. In this embodiment gate controller 230 includes the same constant current source 306 shown within FIG. 3, which discharges capacitor 210 with constant current I2C when switch 226 is closed. Gate controller 230 includes a constant current source 604, N-channel MOSFET M2 and current mirror 606. The combination of M2 and current mirror 606 implement one embodiment of variable current source 304 shown within FIG. 3. M2 transmits a reference current IR, which varies with ILOAD as will be more fully described below. Current mirror 606 has a scaling factor N. Current mirrors are well known in the art. A current mirror is a circuit designed to "copy" a reference current through one active device by controlling the current in another active device. IR is the current being "copied" by current mirror 606. Constant current source 604 and current mirror 606 charge capacitor 210 with constant current I1*m* and variable current IR/N, respectively, when switch 224 is closed. IR is related to ILOAD. The relationship is defined by the relative sizes of M1 and M2. M1 has a gate with W1 and a gate length L1, while M2 has a gate with W2 and a gate length L2. The gates of M1 and M2 are coupled together, and the sources M1 and M2 are coupled together as shown. In this configuration reference current IR=(ILOAD·W2·L1)/(W1·L2). The lengths and widths of M1 and M2 should be selected so that IR is a fraction of ILOAD. Variable charging current IR/N=(ILOAD·W2·L1)/(W1·L2·N). When switch 224 is closed, current mirror 606 and constant current source 604 charge capacitor 210 with variable current IR/N and constant current I1*m*. Gate voltage Vg, and thus VLOAD, increases as capacitor 210 is charged by IR/N and I1*m*. M1, M2, N, and I1*m* should be selected so that Vg increases at a rate that is slower than the rate at which VLOAD increases to avoid overshooting VRER_HI.

Figure 7:
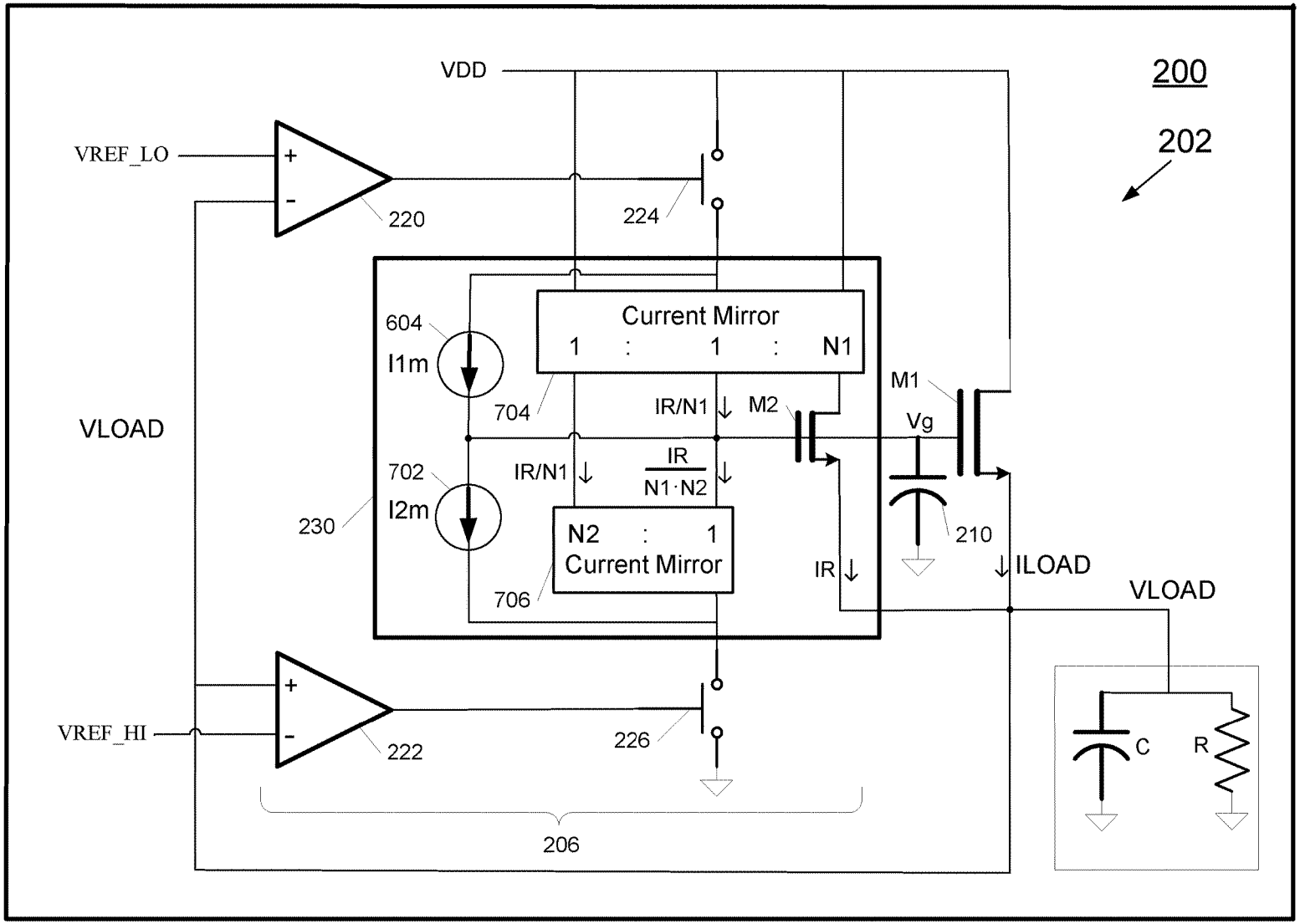
FIG. 7 illustrates an embodiment of the pass device gate controller employed in the voltage regulator of FIG. 2.

FIG. 7 illustrates another embodiment of the gate controller 230 shown in FIG. 2. Similarities exist between the gate controllers 230 shown in FIGS. 6 and 7. More particularly, gate controller 230 of FIG. 7 includes the same constant current source 604, and N-channel MOSFET M2 that transmits reference current IR=(ILOAD·W2·L1)/(W1·L2). However, substantial differences exist between the gate controllers 230 of FIGS. 6 and 7. The gate controller 230 in FIG. 7 includes constant current source 702, current mirror 704, and current mirror 706. Constant current source 604 and current mirror 704 charge capacitor 210 with constant current I1*m* and variable current IR/N1, respectively, when switch 224 is closed. Gate voltage Vg, and thus VLOAD, increases as capacitor 210 is charged by IR/N1=(ILOAD·W2·L1)/(W1·L2·N1) and I1*m*. M1, M2, N1, and I1*m* should be selected so that Vg should increases at a rate that is slower than the rate at which VLOAD increases. Current mirror 704 provides a separate variable current IR/N1 to current mirror 706 as a reference current. Current mirror 706 may be one embodiment of the variable current source 404 shown in FIG. 4. Current mirror 704 has a scaling factor N2, which is distinct from scaling factor N1. In one embodiment, N2 is greater than N1. In another embodiment, N1 and N2 may be substantially equal. When switch 226 is closed, constant current source 702 and current mirror 706 discharge capacitor 210 with constant current I2*m* and variable current IR/(N1·N2)=(ILOAD·W2·L1)/(W1·L2·N1·N2), respectively. Gate voltage Vg, and thus VLOAD, decrease as capacitor 210 is discharged by IR/(N1·N2) and I2*m*. M1, M2, N1, N2 and I2*m* should be selected so that Vg decreases at a rate that is slower than the rate at which VLOAD decreases.

As noted above, pass device gate controller 230 should be configured to change Vg as fast as possible, but at a rate that is slower than the rate at which VLOAD changes, at least towards the end of the charging or discharging cycle, in order to prevent VLOAD from overshooting VREF_HI or undershooting VREF_LO. For example M1, M2, N, and I1*m* in FIG. 6 should be selected so that Vg increases at a rate that is slower than the rate at which VLOAD increases. M1, M2, N1, and I1*m* in FIG. 7 should be selected so that Vg increases at a rate that is slower than the rate at which VLOAD increases. And M1, M2, N1, N2 and I2*m* in FIG. 7 should be selected so that Vg decreases at a rate that is slower than the rate at which VLOAD decreases. M2 should be a fraction of the size of M1 (e.g., M2:M1=1:1000). N1, N2, I1*m* and I2*m* may be selected based on the load transient requirements. For instance, for minimum load (e.g. R→infinite) the regulator loop will only rely on I1*m* and I2*m* to control the loop (that is Vg) since the current from mirrored devices are too small.

Figure 8A:
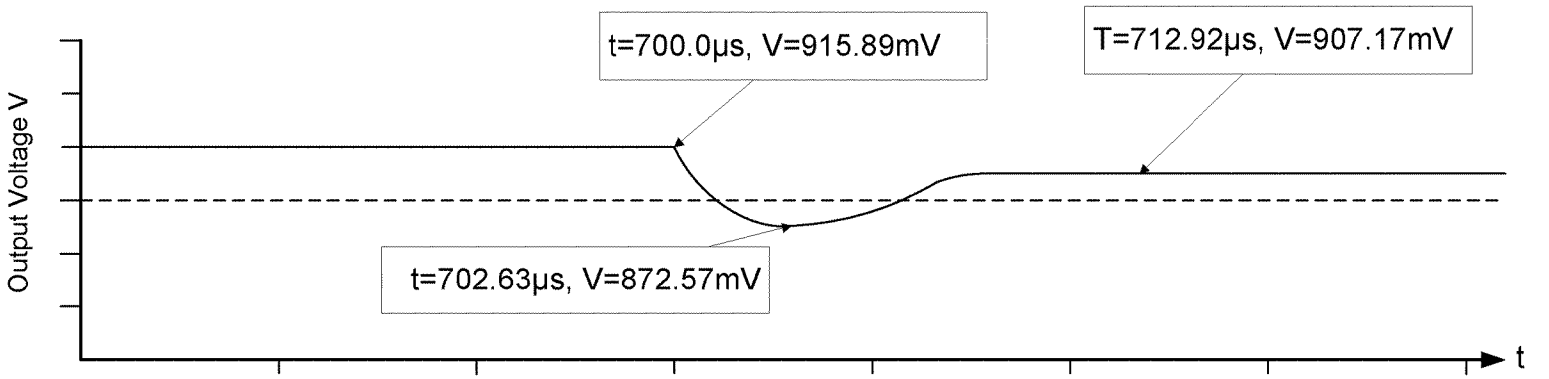
FIGS. 8*a*-8*c* illustrate example responses by the voltage regulator of FIG. 6 to various load steps.
Figure 8B:
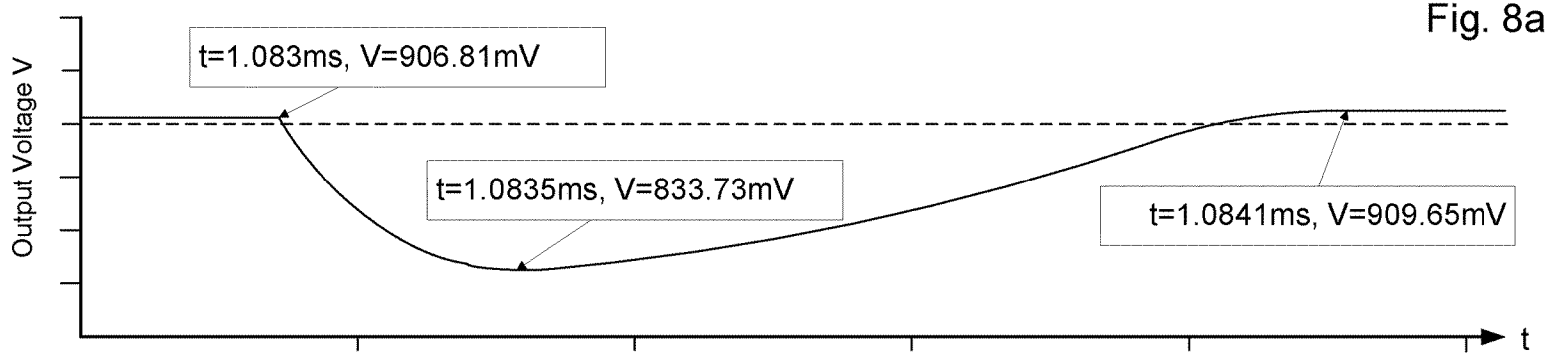
Figure 8C:
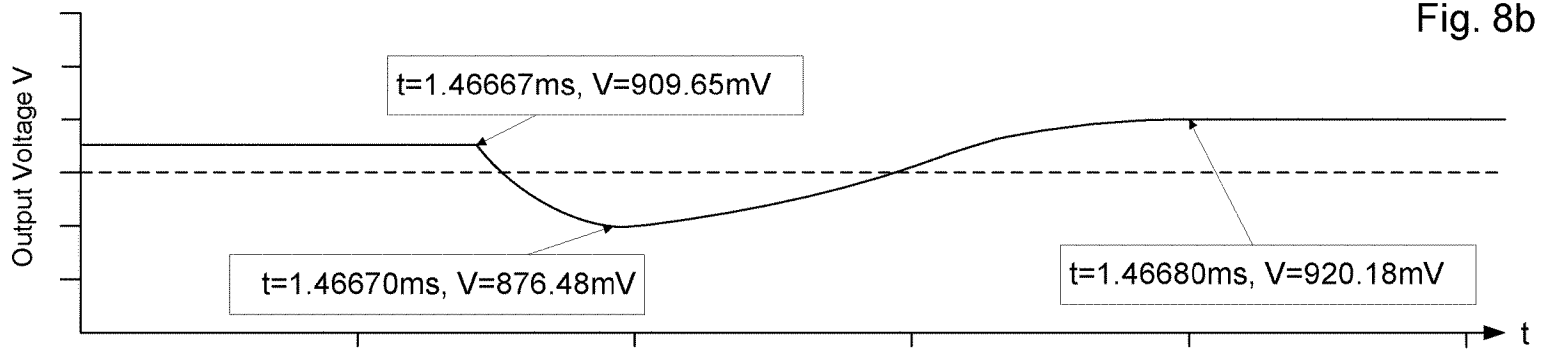

Pass device gate controller 230 also promotes a fast and stable response according to the imposed load at a low area cost, while maintaining low power characteristics. For example, FIGS. 8*a*-8*c* illustrate transient waveforms for CVR 202 shown in FIG. 6 with three different load steps and with VREF_LO=0.9 V. FIG. 8*a* shows the output voltage response to a load step of approximately 10 μA from a leakage current of 2 μA at t=700 μs. FIG. 8*b* shows the output voltage response to a load step of approximately 315 μA from a quiescent current of 12 μA t=1.083 ms. FIG. 8*c* shows the output voltage response to a load step of approximately 315 μA from a quiescent current of 12 μA at t=1.4667 ms. In all three cases, it can be seen that the output voltage presents fast recovery time Δt with a smooth transient behavior.

An integrated circuit (IC) according to a first embodiment is disclosed that includes a load circuit, and a voltage regulator circuit configured to provide a load voltage and a load current to the load circuit. The voltage regulator circuit can regulate the load voltage based on the load current. The IC may also include a conductor for providing a supply voltage. The voltage regulator may include a transistor having a first current electrode coupled to the conductor, a second current electrode coupled to the load circuit and configured to provide the load voltage and the load current to the load circuit, and a control electrode for controlling the first transistor. The voltage regulator may further include a capacitor coupled to the control electrode, wherein the control circuit controls the voltage by charging or discharging the capacitor with a charging current that varies with the load current or discharging current that varies with the load current. The voltage regulator may also include a control circuit that controls a voltage at the control electrode based on the load voltage and the load current. Or the voltage regulator may include a capacitor coupled to the control electrode, wherein the control circuit controls the voltage by charging the capacitor with a charging current that varies with the load current. The control circuit may be coupled to the second current electrode, and the control circuit may generate the charging or discharging current based on the load current. Or the voltage regulator may include a first conductor for providing a supply voltage, a second conductor for providing a ground voltage, a first transistor that has a first current electrode coupled to the first conductor, a second current electrode coupled to the load circuit and configured to provide the load voltage and the load current to the load circuit, and a first control electrode. This alternative voltage regulator may further include a capacitor coupled to the first control electrode, a control circuit, a first comparator for comparing a first reference voltage to the load voltage, a second comparator for comparing a second reference voltage to the load voltage, a first switch controlled by the first comparator, wherein the first switch is coupled between the first conductor and the control circuit, a second switch controlled by the second comparator, wherein the second switch is coupled between the second conductor and the control circuit, wherein the first comparator may close the first switch to couple the control circuit to the first conductor when the first reference voltage exceeds the load voltage, wherein the control circuit may charge the capacitor with a charging current when the first switch is closed, wherein a magnitude of the charging current can be based on the load current, wherein the second comparator may close the second switch to couple the control circuit to the second conductor when the load voltage exceeds the second reference voltage, and wherein the control circuit may discharge the capacitor with a discharging current when the second switch is closed. The control circuit may include a current mirror, a second transistor having a third current electrode coupled to the current mirror, a fourth current electrode coupled to the load circuit and configured to transmit a reference current from the current mirror to the load circuit, and a second control electrode coupled to the capacitor, wherein the charging current may be proportional to the reference current.

An integrated circuit (IC) according to a second embodiment is disclosed that includes a load circuit, a conductor for providing a supply voltage, and a voltage regulator circuit configured to provide a load voltage and a load current to the load circuit. In this second embodiment, the voltage regulator circuit includes a first transistor coupled between the conductor and the load circuit, the first transistor having a control electrode. The voltage regulator of the second embodiment further includes a capacitor coupled to the control electrode, and a control circuit that charges the capacitor with a non-linear charging current or discharges the capacitor with a non-linear discharging current. The voltage regulator circuit may further include a variable charging current source for providing the non-linear charging current. This voltage regulator circuit may further include a variable discharging current source for providing the non-linear discharging current. The voltage regulator circuit may further include a first comparator for comparing the load voltage against a first reference voltage, wherein the first comparator can assert a first signal when the first voltage reference exceeds the load voltage, and wherein the voltage regulator can charge the capacitor with the non-linear charging current when the first signal is asserted. The non-linear charging current may be proportional to the load current. The voltage regulator circuit may further include a linear charging current for charging the capacitor with a linear charging current when the first signal is asserted. The variable charging current source may include a current mirror that provides the non-linear charging current.

An integrated circuit (IC) according to a third embodiment is disclosed that includes a conductor for providing a supply voltage, a load circuit, and a voltage regulator circuit configured to provide a load voltage and a load current to the load circuit. In the third embodiment, the voltage regulator circuit includes a control circuit that senses the load current, a first transistor coupled between the conductor and the load circuit, the first transistor comprising a control electrode, wherein the control circuit controls a voltage at the control electrode based upon the sensed load current. The voltage regulator circuit may further include a capacitor coupled to the control electrode, and a variable charging current source for charging the capacitor with a non-linear charging current. Or the voltage regulator circuit may further include a capacitor coupled to the control electrode, and a variable discharging current source for discharging the capacitor with a non-linear discharging current. The voltage regulator circuit may include a first conductor for supplying a first voltage, a comparator for comparing a reference voltage to the load voltage, a switch controlled by the comparator, wherein the switch is coupled between the first conductor and the variable charging current source, and wherein the comparator closes the switch to couple the variable charging current source to the first conductor when the load voltage exceeds the reference voltage. Or the voltage regulator may further include a first conductor for supplying a first voltage, a comparator for comparing a reference voltage to the load voltage, a switch controlled by the comparator, wherein the switch is coupled between the first conductor and the variable discharging current source, and wherein the comparator closes the switch to couple the variable discharging current source to the first conductor when the reference voltage exceeds the load voltage. The variable charging current source may include a current mirror.

Although the present invention has been described in connection with several embodiments, the invention is not intended to be limited to the specific forms set forth herein. On the contrary, it is intended to cover such alternatives, modifications, and equivalents as can be reasonably included within the scope of the invention as defined by the appended claims.

What is claimed is:

1. An integrated circuit (IC) comprising:

a load circuit;

a voltage regulator circuit configured to provide a load voltage and a load current to the load circuit, the voltage regulator circuit comprising:

a transistor comprising a first current electrode coupled to a supply conductor, a second current electrode coupled to the load circuit and configured to provide the load voltage and the load current to the load circuit, and a control electrode for controlling the transistor;

a capacitor coupled to the control electrode;

a control circuit that charges the capacitor with a charging current that varies with the load current, wherein the voltage regulator comprises:

a first comparator for comparing a first reference voltage to the load voltage;

a first switch controlled by the first comparator, wherein the first switch is coupled between a first conductor and the control circuit;

wherein the first comparator closes the first switch to couple the control circuit to the supply conductor when the first reference voltage exceeds the load voltage;

wherein the control circuit comprises:

a current mirror;

a second transistor comprising a third current electrode coupled to the current mirror, a fourth current electrode coupled to the load circuit and configured to transmit a reference current from the current mirror to the load circuit, and a second control electrode coupled to the capacitor;

wherein the charging current is proportional to the reference current, and the control circuit charges the capacitor with the charging current when the first switch is closed.

2. The IC of claim 1 wherein the control circuit charges the capacitor when the load voltage falls below a first reference voltage.

3. The IC of claim 2 wherein the control circuit discharges the capacitor with a discharging current that varies with the load current.

4. The IC of claim 3 wherein the control circuit discharges the capacitor when the load voltage rises above a second reference voltage.

5. The IC of claim 4 wherein the control circuit is coupled to the second current electrode.

6. The IC of claim 1 wherein the voltage regulator comprises:

a second comparator for comparing the second reference voltage to the load voltage;

a second switch controlled by the second comparator, wherein the second switch is coupled between a second conductor and the control circuit;

wherein the second comparator closes the second switch to couple the control circuit to a ground conductor when the load voltage exceeds the second reference voltage;

wherein the control circuit discharges the capacitor with a discharging current when the second switch is closed.

7. An integrated circuit (IC) comprising:

a conductor for providing a supply voltage;

a load circuit;

a voltage regulator circuit configured to provide a load voltage and a load current to the load circuit;

the voltage regulator circuit comprising:

a control circuit that senses the load current;

a first transistor coupled between the conductor and the load circuit, the first transistor comprising a control electrode;

wherein the voltage regulator circuit further comprises:

a capacitor coupled to the control electrode;

a variable charging current source for charging the capacitor with a non-linear charging current based upon the sensed load current;

a first conductor for supplying a first voltage;

a comparator for comparing a reference voltage to the load voltage;

a switch controlled by the comparator, wherein the switch is coupled between the first conductor and the variable charging current source;

wherein the comparator closes the switch to couple the variable charging current source to the first conductor when the load voltage exceeds the reference voltage.

8. The IC of claim 7 wherein the voltage regulator circuit further comprises:

a variable discharging current source for discharging the capacitor with a second non-linear charging current.

9. The IC of claim 8 wherein the voltage regulator circuit further comprises:

a second conductor for supplying a second voltage;

a second comparator for comparing a second reference voltage to the load voltage;

a second switch controlled by the second comparator, wherein the second switch is coupled between the second conductor and the second variable charging current source;

wherein the second comparator closes the second switch to couple the variable discharging current source to the second conductor when the reference voltage exceeds the load voltage.

10. The IC of claim 7 wherein the variable charging current source comprises a current mirror.

11. An integrated circuit (IC) comprising:

a conductor for providing a supply voltage;

a load circuit;

a voltage regulator circuit configured to provide a load voltage and a load current to the load circuit;

the voltage regulator circuit comprising:

a control circuit that senses the load current;

a first transistor coupled between the conductor and the load circuit, the first transistor comprising a control electrode;

wherein the voltage regulator circuit further comprises:

a capacitor coupled to the control electrode;

a variable discharging current source for discharging the capacitor with a non-linear discharging current;

a first conductor for supplying a first voltage;

a comparator for comparing a reference voltage to the load voltage;

a switch controlled by the comparator, wherein the switch is coupled between the first conductor and the variable discharging current source;

wherein the comparator closes the switch to couple the variable discharging current source to the first conductor when the reference voltage exceeds the load voltage.

12. The IC of claim 11 wherein the variable discharging current source comprises a current mirror.

* * * * *